US008334825B2

(12) United States Patent
Kim

(10) Patent No.: US 8,334,825 B2
(45) Date of Patent: Dec. 18, 2012

(54) ORGANIC LIGHT EMITTING DISPLAY FOR SUPPRESSING IMAGES STICKING AND COMPENSATING A THRESHOLD VOLTAGE

(75) Inventor: Yangwan Kim, Yongin-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 939 days.

(21) Appl. No.: 12/071,851

(22) Filed: Feb. 27, 2008

(65) Prior Publication Data

US 2008/0211747 A1 Sep. 4, 2008

(30) Foreign Application Priority Data

Mar. 2, 2007 (KR) ..... 10-2007-0020736

(51) Int. Cl.
*G09G 3/32* (2006.01)

(52) U.S. Cl. ..... 345/82

(58) Field of Classification Search ..... 345/36, 345/39, 44–46, 74.1–83; 315/169.3; 313/463
See application file for complete search history.

(56) References Cited

U.S. PATENT DOCUMENTS

| | | | | |
|---|---|---|---|---|
| 7,319,443 | B2 * | 1/2008 | Kimura et al. | 345/76 |
| 7,324,101 | B2 | 1/2008 | Miyazawa | |
| 7,414,599 | B2 | 8/2008 | Chung et al. | |
| 2006/0022305 | A1 * | 2/2006 | Yamashita | 257/565 |
| 2006/0077077 | A1 | 4/2006 | Kwon | |
| 2006/0186822 | A1 | 8/2006 | Park | |
| 2006/0221005 | A1 * | 10/2006 | Omata et al. | 345/76 |
| 2006/0253755 | A1 | 11/2006 | Wu | |
| 2007/0024543 | A1 | 2/2007 | Chung et al. | |

FOREIGN PATENT DOCUMENTS

| | | | |
|---|---|---|---|
| EP | 1 750 246 | A | 2/2007 |
| JP | 2003-108067 | A | 4/2003 |
| JP | 2006-138953 | A | 6/2006 |
| JP | 2007-041586 | A | 2/2007 |
| JP | 2008-191450 | A | 8/2008 |
| KR | 10-2005-0005646 | A | 1/2005 |
| KR | 10-2005-0119367 | A | 12/2005 |
| KR | 10-2006-0004615 | A | 1/2006 |
| KR | 10-2007-0019463 | A | 2/2007 |

* cited by examiner

*Primary Examiner* — Chanh Nguyen
*Assistant Examiner* — Ram Mistry
(74) *Attorney, Agent, or Firm* — Lee & Morse, P.C.

(57) ABSTRACT

An organic light emitting display includes a first switching element including a control electrode electrically coupled to a scan line and between a data line and a first voltage line, a driving transistor electrically coupled between the first voltage line and a second voltage line, a second switching element including a control electrode electrically coupled to a light emission control line and between the first voltage line and the driving transistor, a third switching element including a control electrode electrically coupled to the scan line and between the second switching element and the driving transistor, a first storage capacitor that is electrically coupled between the first voltage line and the control electrode of the driving transistor, a second storage capacitor that is electrically coupled between the first storage capacitor and the second switching element, and an OLED electrically coupled between the driving transistor and the second voltage line.

24 Claims, 5 Drawing Sheets

ORGANIC LIGHT EMITTING DISPLAY FOR SUPPRESSING IMAGES STICKING AND COMPENSATING A THRESHOLD VOLTAGE

BACKGROUND OF THE INVENTION

1. Field of the Invention

Embodiments of the invention relate to an organic light emitting display. More particularly, embodiments relate to an organic light emitting display that may suppress image sticking due to a decrease in efficiency of an organic light emitting diode and may compensate for a threshold voltage of a driving transistor.

2. Description of the Prior Art

In general, an organic light emitting display is a display that emits light by electrically exciting a fluorescent or phosphorescent compound. The organic light emitting display may display an image by driving N×M organic light emitting diodes (OLEDs). Each OLED may include an anode electrode (indium tin oxide (ITO)), an organic thin-film layer, and a cathode electrode (metal). To improve light emission efficiency and a balance between electrons and holes, the organic thin-film layer may have a multi-layer structure including an emitting layer (EML), an electron transport layer (ETL) and a hole transport layer (HTL). The organic thin-film may include a separate electron injecting layer (EIL) and a hole injecting layer (HIL).

In general, the anode electrode is coupled to a first power supply to supply holes to the EML, and the cathode electrode is coupled with a second power supply to supply electrons to the EML. The second power supply has a lower voltage than the first power supply. Thus, relative to cathode electrode, the anode electrode has a positive (+) electric potential and, relative to the anode electrode, the cathode electrode has a (−) electrode potential.

The HTL accelerates hole(s) supplied from the anode electrode and supplies the hole(s) to the EML. The ETL accelerates electron(s) supplied from the cathode electrode and supplies the electron(s) to the EML. As a result, at the EML, the electron(s) supplied from the ETL and the hole(s) supplied from the HTL may recombine with each other, thereby generating a predetermined amount of light. The EML layer may include organic material that may generate one of red light, green light and blue light when the electron(s) and hole(s) recombine therein.

In such OLEDs, because a voltage applied to the anode electrode is always higher than a voltage applied to the cathode electrode, negative (−) carriers are positioned on the anode electrode, and positive (+) carriers are positioned on the cathode electrode. If the negative (−) carriers positioned on the anode electrode and the positive (+) carriers positioned on the cathode electrode are maintained for a long time, movement of electron(s) and hole(s) may decrease. Thus, efficiency of the OLED(s) may decrease the more the OLED(s) is used. As a result, image sticking may occur and a life span of the OLED(s) may be shortened.

SUMMARY OF THE INVENTION

Embodiments of the invention are therefore directed to organic light emitting display(s) that substantially overcomes one or more of the problems due to the limitations and disadvantages of the related art.

It is therefore a feature of an embodiment of the invention to provide an organic light emitting display that can reduce and/or completely suppress image sticking due to a decrease in efficiency of an organic light emitting diode by controlling the amount of a current supplied to an organic light emitting diode.

It is therefore a separate feature of an embodiment of the invention to provide an organic light emitting display that may realize a high-grayscale organic light emitting display by substantially and/or completely compensating for irregularity of a threshold voltage of a driving transistor.

At least one of the above and other features and advantages of the invention may be realized by providing an organic light emitting display, including a first switching element including a control electrode electrically coupled to a scan line and being electrically coupled between a data line and a first voltage line, a driving transistor that is electrically coupled between the first voltage line and a second voltage line, a second switching element including a control electrode electrically coupled to a light emission control line and being electrically coupled between the first voltage line and the driving transistor, a third switching element including a control electrode electrically coupled to the scan line and being electrically coupled between the second switching element and the driving transistor, a first storage capacitor that is electrically coupled between the first voltage line and the control electrode of the driving transistor, a second storage capacitor that is electrically coupled between the first storage capacitor and the second switching element, and an organic light emitting diode that is electrically coupled between the driving transistor and the second voltage line.

The first switching element may include a first electrode electrically coupled to the data line, and a second electrode electrically coupled to a first electrode of the driving transistor. The second switching element may include a first electrode electrically coupled between the third switching element and the second storage capacitor, and a second electrode electrically coupled to the first voltage line.

The third switching element may include a first electrode electrically coupled to an anode of the organic light emitting diode, and a second electrode electrically coupled to a first electrode of the second switching element. The first storage capacitor may include a first electrode electrically coupled to the first voltage line and a second electrode electrically coupled between a control electrode of the driving transistor and a first electrode of the second storage capacitor.

The second storage capacitor may include a first electrode electrically coupled to a control electrode of the driving transistor and a second electrode electrically coupled between a first electrode of the second switching element and a second electrode of the third switching element. The driving transistor may include a control electrode electrically coupled between the first storage capacitor and the second storage capacitor, a first electrode electrically coupled between the first switching element and the first voltage line, and a second electrode electrically coupled to an anode of the organic light emitting diode.

The organic light emitting diode may include an anode electrically coupled between a first electrode of the third switching element and a second electrode of the driving transistor and a cathode electrically coupled to the second voltage line. The driving transistor may be electrically coupled to a fourth switching element adapted to initialize a voltage stored in the first and second storage capacitors by applying an initialization voltage to a control electrode of the driving transistor.

The fourth switching element may include a control electrode electrically coupled to a previous scan line, a first electrode electrically coupled between the first storage capacitor and the second storage capacitor, and a second electrode electrically coupled to a third voltage line. The driving transistor may be electrically coupled to a fifth switching element that connects the driving transistor in a diode-coupled manner.

The fifth switching element may include a control electrode electrically coupled to the scan line, a first electrode electrically coupled to a control electrode of the driving transistor, and a second electrode electrically coupled between an anode of the organic light emitting diode and a second electrode of the driving transistor. The driving transistor may be electrically coupled to a sixth switching element that applies a first voltage to the driving transistor.

The sixth switching element may include a control electrode electrically coupled to the light emission control line, a first electrode electrically coupled between the first switching element and the driving transistor, and a second electrode electrically coupled between the first voltage line and the first storage capacitor.

The display may further include a seventh switching element that is adapted to apply a driving current to the organic light emitting diode and is electrically coupled between the driving transistor and the organic light emitting diode. The seventh switching element may include a control electrode electrically coupled to the light emission control line, a first electrode electrically coupled between the driving transistor and a fifth switching element, and a second electrode electrically coupled between the organic light emitting diode and the third switching element.

The display may further include a fourth switching element that is electrically coupled between the first storage capacitor and a third voltage line and includes a control electrode electrically coupled to a previous scan line, a fifth switching element adapted to connect the driving transistor is a diode-coupled manner, a sixth switching element including a control electrode electrically coupled to the light emission control line and being electrically coupled between the driving transistor and the first voltage line, and a seventh switching element including a control electrode electrically coupled to the light emission control line and being electrically coupled between the driving transistor and the organic light emitting diode.

The fourth switching element may include a first electrode electrically coupled between the first storage capacitor and the second storage capacitor, and a second electrode electrically coupled to the third voltage line. The sixth switching element may include a first electrode electrically coupled between the first switching element and the driving transistor, and a second electrode electrically coupled between the first voltage line and the first storage capacitor.

The seventh switching element may include a first electrode electrically coupled to the driving transistor, and a second electrode electrically coupled between the organic light emitting diode and the third switching element. A second voltage of the second voltage line may be lower than a first voltage of the first voltage line.

The display may further include a fourth switching element that is electrically coupled between the first storage capacitor and a previous scan line and includes a control electrode electrically coupled to the previous scan line, a fifth switching element that is adapted to diode-couple the driving transistor, a sixth switching element including a control electrode electrically coupled to the light emission control line and being electrically coupled between the driving transistor and the first voltage line, and a seventh switching element including a control electrode electrically coupled to the light emission control line and being electrically coupled between the driving transistor and the organic light emitting diode.

The fourth switching element may include a first electrode electrically coupled between the first storage capacitor and the second storage capacitor, and a second electrode electrically coupled to the previous scan line. The sixth switching element may include a first electrode electrically coupled between the first switching element and the driving transistor, and a second electrode electrically coupled between the first voltage line and the first storage capacitor.

The seventh switching element may include a first electrode electrically coupled to the driving transistor, and a second electrode electrically coupled between the organic light emitting diode and the third switching element.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
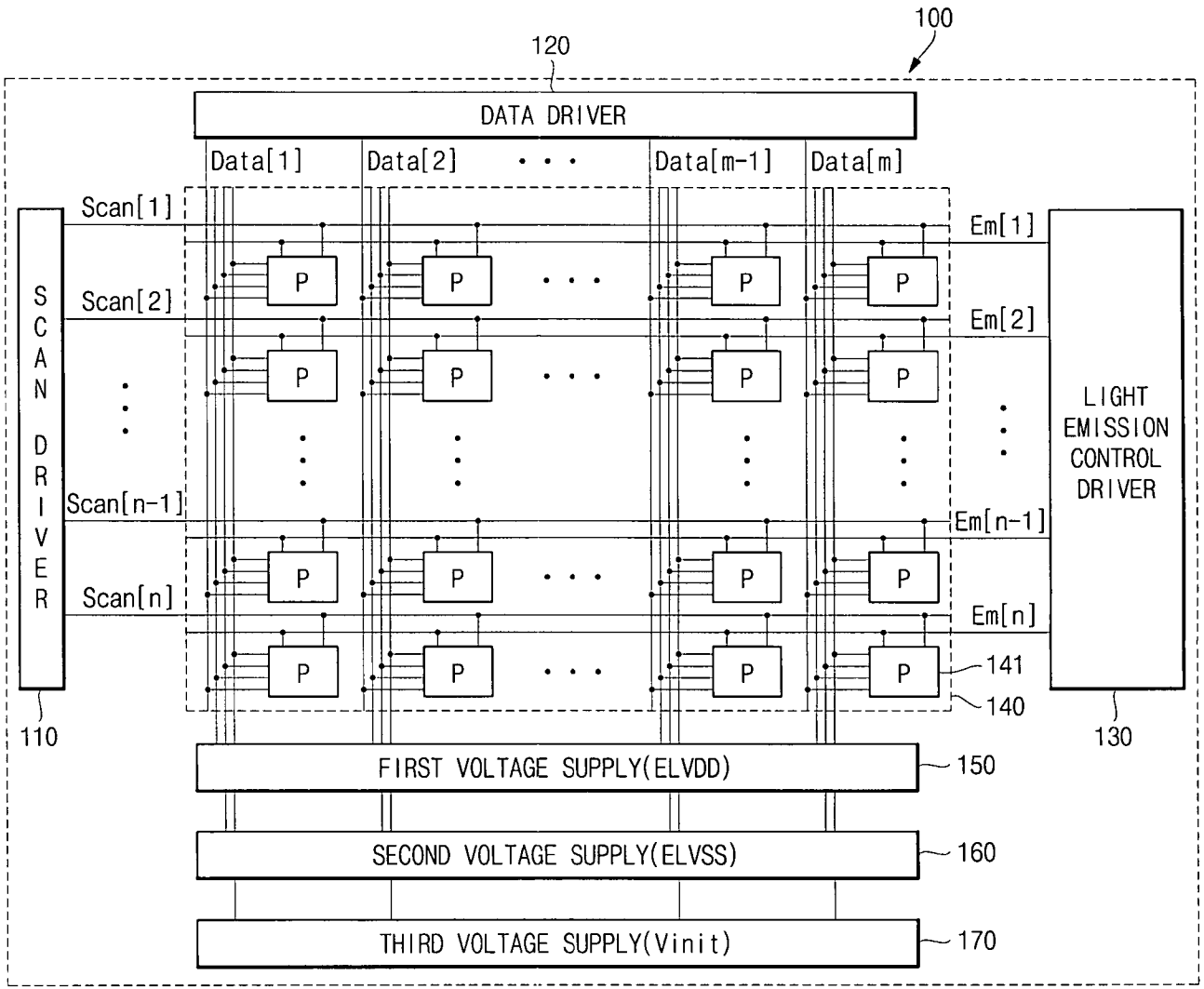
FIG. 1 illustrates a block diagram of an exemplary organic light emitting display according to an exemplary embodiment of the invention.

Korean Patent Application No. 10-2007-0020736, filed on Mar. 2, 2007, in the Korean Intellectual Property Office, and entitled: "Organic Light Emitting Display," is incorporated by reference herein in its entirety.

Embodiments of the invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

Elements having similar constitutions and/or operations are denoted by the same and/or like reference numerals throughout the specification. Furthermore, it should be understood that electrical coupling between a certain component and another component includes direct electrical coupling between them as well as indirect electrical coupling between them by an interposed component. It will also be understood that, unless specified otherwise, when an element is referred to as being "between" two elements, it can be the only element between the two elements, or one or more intervening elements may also be present.

FIG. 1 illustrates a block diagram of an organic light emitting display 100, as an exemplary flat panel display, according to an exemplary embodiment of the invention.

Referring to FIG. 1, the organic light emitting display 100 may include a scan driver 110, a data driver 120, a light emission control driver 130, an organic light emitting display panel 140 (hereinafter, referred to as a "panel"), a first voltage supply 150, a second voltage supply 160 and a third voltage supply 170.

The scan driver 110 may sequentially apply a scan signal(s) to the panel 140 through a plurality of scan lines (Scan[1], Scan[2], . . . , and Scan [n]).

The data driver 120 may apply a data signal(s) to the panel 140 through a plurality of data lines (Data[1], Data[2], . . . , and Data[m]).

The light emission control driver 130 may sequentially apply a light emission control signal(s) to the panel 140 through a plurality of light emission control lines (Em[1], Em[2], . . . , and Em[n]).

The panel 140 may include the plurality of scan lines (Scan[1], Scan[2], . . . , and Scan [n]) and the plurality of light emission control lines (Em[1], Em[2], . . . , and Em[n]) arranged in a column direction, the plurality of data lines (Data[1], Data[2], . . . , and Data[m]) arranged in a row direction, and a plurality of pixel circuit(s) 141.

The pixel circuits 141 may be at least partially defined by respective portions of the plurality of scan lines (Scan[1], Scan[2], . . . , and Scan [n]), the plurality of data lines (Data [1], Data[2], . . . , and Data[m]) and the plurality of light emission control lines (Em[1], Em[2], . . . , and Em[n]). More particularly, each of the pixel circuits 141 may be formed in a region defined by respective portions of two neighboring ones of the plurality of scan lines (Scan[1], Scan[2], . . . , and Scan [n]) (or two neighboring ones of the light emission control lines (Em[1], Em[2], . . . , and Em[n])) and two neighboring ones of the plurality of data lines (Data[1], Data[2], . . . , and Data[m]).

The pixel circuits 141 may be driven by respective ones of the plurality scan lines (Scan[1], Scan[2], . . . , Scan[n]), the plurality of data lines (Data[1], Data[2], . . . , Data[m]), and the plurality of light emission control lines (Em[1], Em[2], . . . , Em[n]). As described above, a scan signal(s) from the scan driver 110 may be applied to the respective one of the scan lines (Scan[1], Scan[2], . . . , and Scan [n]), and a data signal(s) from the data driver 120 may be applied to a respective one of the data lines (Data[1], Data[2], . . . , and Data[m]), and a light emission control signal(s) from the light emission control driver 130 may be applied to a respective one of the light emission control lines (Em[1], Em[2], . . . , and Em[n]).

The first voltage supply 150, the second voltage supply 160, and the third voltage supply 170 may respectively supply a first voltage ELVDD, a second voltage ELVSS, and a third voltage Vinit to the respective pixel circuits 141 of the panel 140.

Figure 2:
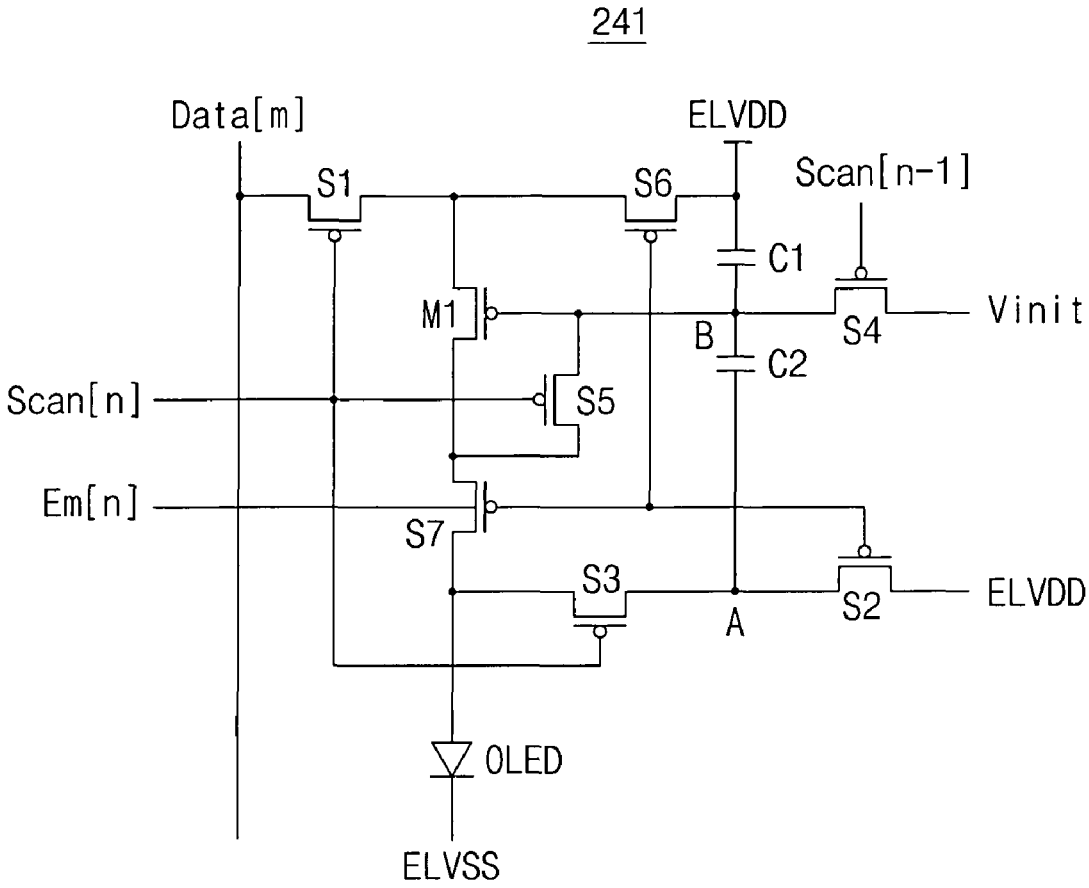
FIG. 2 illustrates a circuit diagram of an exemplary pixel circuit employable by an organic light emitting display according to an exemplary embodiment of the present invention.

FIG. 2 illustrates a circuit diagram of an exemplary pixel circuit 241 employable by an organic light emitting display according to an exemplary embodiment of the present invention. For example, one, some or all of the pixel circuits 141 of the organic light emitting display of FIG. 1 may correspond to the pixel circuit 241 illustrated in FIG. 2. For ease of description, the pixel circuit 241 is illustrated as being coupled to the nth scan line (Scan[n]), the mth data line (Data[m]) and the nth light emission control line (Em[n]) of the organic light emitting display 100 of FIG. 1.

More particularly, referring to FIG. 2, the pixel circuit 241 may be coupled to nth scan line (Scan[n]), a previous scan line (Scan [n−1]), the mth data line (Data[m]), the nth light emission control line (Em[n]), a first voltage line supplying the first voltage (ELVDD), a second voltage line supplying the second voltage (ELVSS), and a third voltage line supplying the third voltage (Vinit). The pixel circuit 241 may include a first switching element (S1), a second switching element (S2), a third switching element (S3), a fourth switching element (S4), a fifth switching element (S5), a sixth switching element (S6), a seventh switching element (S7), a first storage capacitor (C1), a second storage capacitor (C2), a driving transistor (M1), and an organic light emitting diode (OLED).

The nth scan line (Scan[n]) may apply a respective scan signal from the scan driver 110 (see FIG. 1) to a control electrode of the first switching element (S1). The pixel circuit 241 may be selected to emit light during a driving period by supplying the scan signal thereto. For example, in embodiments in which the first switching transistor (S1) is a p-type transistor, the scan signal may be described as 'supplied' when the scan signal has a low voltage level. When the scan signal is supplied to the pixel circuit 241, the OLED thereof may emit light during the respective driving period. The nth scan line (Scan[n]) is electrically coupled to the scan driver 110, which may produce the respective scan signal(s).

The previous, e.g., (n−1)th, scan line (Scan[n−1]) may apply a previous scan signal supplied during a prior scanning period to the (n−1)th scan line to a control electrode of the fourth switching element (S4). Thus, the previous scan signal may control the fourth switching element (S4). When the fourth switching element is in an on state, the fourth switching element (S4) may apply the third voltage (Vinit) to the first and second storage capacitors (C1 and C2) and initialize a stored voltage therein.

The mth data line (Data[m]) may apply a data signal (voltage), from the data driver 120 (see FIG. 1) to the first storage capacitor (C1) and the driving transistor (M1). The voltage of the data signal may be proportional to a light emission brightness of the OLED of the pixel circuit 241. The mth data line (Data[m]) may be electrically coupled to the data driver 120, which may produce the respective data signal(s).

The nth light emission control line (Em[n]) may be electrically coupled to a control electrode of the seventh switching element (S7) and may apply a light emission control signal to pixel circuit 241. The light emission control signal may control a light emission time of the OLED of the pixel circuit 241. The nth light emission control line (Em[n]) may be electrically coupled to control electrodes of the second and fifth switching elements (S2 and S5), and may control the second and fifth switching elements (S2 and S5). The nth light emission control line (Em[n]) may be electrically coupled to the light emission control driver 130 (see FIG. 1), which produces the respective light emission control signal(s).

The first voltage line may enable the first voltage (ELVDD) to be applied to the OLED of the pixel circuit 241. The first voltage line may be coupled to the first voltage supply 150 (see FIG. 1), which may supply the first voltage (ELVDD).

The second voltage line may enable the second voltage (ELVSS) to be applied to the OLED of the pixel circuit 241. The second voltage line may be coupled to the second voltage supply 160 (see FIG. 1), which may supply the second voltage (ELVSS). The first voltage (ELVDD) may be higher than the second voltage (ELVSS).

The third voltage line may enable the third voltage (Vinit) to be applied to the first and second storage capacitors (C1 and C2). The third voltage line may be coupled to the third voltage supply 170 (see FIG. 1), which may supply the third voltage (Vinit).

Referring to FIG. 2, the first switching element (S1) may include a first electrode electrically coupled to the mth data line (Data[m]), a second electrode electrically coupled to a first electrode of the driving transistor (M1), and a control electrode electrically coupled to the nth scan line (Scan[n]). The first switching element (S1) may be turned on when a scan signal of a low level is applied, via the nth scan line (Scan[n]), to the control electrode thereof. When the first switching element (S1) is turned on, a respective data signal supplied to the mth data line (Data[m]) may be applied to the first electrode of the driving transistor (M1).

The second switching element (S2) may include a first electrode electrically coupled between the second storage capacitor (C2) and the third switching element (S3), a second electrode electrically coupled to the first voltage line, and a control electrode electrically coupled to the nth light emission control line (Em[n]). The second switching element (S2) may be turned on when a light emission control signal of a low level is applied, via the nth light emission control line (Em[n]), to the control electrode thereof. When the second switching element is turned on, the first voltage (ELVDD) may be applied to a second electrode of the second storage capacitor (C2).

The third switching element (S3) may include a first electrode electrically coupled between the seventh switching element (S7) and the OLED, a second electrode electrically coupled between the second storage capacitor (C2) and the second switching element (S2), and a control electrode electrically coupled to the nth scan line (Scan[n]). The third switching element (S3) may be turned on when a scan signal of a low level is applied, via the nth scan line (Scan[n]), to the control electrode thereof. When the third switching element (S3) is turned on, a threshold voltage of the OLED may be applied to the second electrode (A) of the second storage capacitor (C2).

The fourth switching element (S4) may include a first electrode electrically coupled to the second electrode of the first storage capacitor (C1) and the first electrode of the second storage capacitor (C2), a second electrode electrically coupled to the third voltage line, and a control electrode electrically coupled to the previous, e.g., (n−1)th, scan line. The fourth switching element (S4) may be turned on when a scan signal of a low level is applied, via the previous scan line (Scan[n−1]), to the control electrode thereof. When the fourth switching element (S4) is turned on, a voltage stored in the first storage capacitor (C1) and the second storage capacitor (C2) may be initialized.

The fifth switching element (S5) may include a first electrode electrically coupled to the control electrode of the driving transistor (M1), a second electrode electrically coupled between the driving transistor (M1) and the seventh switching element (S7), and a control electrode electrically coupled to the nth scan line (Scan[n]). The fifth switching element (S5) may be turned on when a scan signal of a low level is applied, via the scan line (Scan[n]), to the control electrode thereof. When the fifth switching element is turned on, the driving transistor (M1) may be in a diode-coupled state.

The sixth switching element (S6) may include a first electrode electrically coupled to the first electrode of the driving transistor (M1), a second electrode electrically coupled between the first voltage line and a first electrode of the first storage capacitor (C1), and a control electrode electrically coupled to the mth light emission control line (Em[n]). The sixth switching element (S6) may be turned on when a light emission control signal of a low level is applied, via the light emission control line (Em[n]), to the control electrode thereof. When the sixth switching element (S6) is turned on, the first voltage (ELVDD) may be supplied to the driving transistor (M1) via the first voltage line.

The seventh switching element (S7) may include a first electrode electrically coupled between the driving transistor (M1) and the fifth switching element (S5), a second electrode electrically coupled between the first electrode of the third switching element (S3) and an anode of the OLED, and a control electrode electrically coupled to the nth light emission control line (Em[n]). The seventh switching element (S7) may be turned on when a light emission control signal of a low level is applied, via the light emission control line (Em[n]), to the control electrode thereof. When the seventh switching element (S7) is turned on, a current may be transferred from the driving transistor (M1) to the OLED.

The first storage capacitor (C1) may include a first electrode electrically coupled to the first voltage line, and the second electrode electrically coupled between the first electrode of the second storage capacitor (C2) and the control electrode of the driving transistor (M1) at a node (B).

The second storage capacitor (C2) may include the node (B) electrically coupled between the driving transistor (M1) and the first storage capacitor (C1), and a node (A) electrically coupled between the second switching element (S2) and the third switching element (S3).

The driving transistor (M1) may include a first electrode electrically coupled with the first voltage line, a second electrode electrically coupled to the anode of the OLED, and a control electrode electrically coupled to the first electrode of the fourth switching element (S4). The driving transistor (M1) may be a p-type channel transistor and may be turned on when a data signal of a low level (or a negative voltage) is applied to the control electrode thereof. When the driving transistor (M1) is turned on, a predetermined amount of current may be supplied from the first voltage line (ELVDD) toward the OLED. Because the data signal of a low level (or a negative voltage) may be applied to the first and second storage capacitors (C1 and C2) and charges them, even when the first switching element (S1) is turned off, the data signal of a low level (or a negative voltage) may be continuously applied to the control electrode of the driving transistor (M1) for a predetermined time as a result of a charged voltage of the first and second storage capacitors (C1 and C2).

In the exemplary embodiment illustrated in FIG. 2, the first, second, third, fourth, fifth, sixth and seventh switching elements (S1, S2, S3, S4, S5, S6, S7) and the driving transistor (M1) are illustrated as p-type transistors. Embodiments of the invention are not limited thereto.

Figure 3:
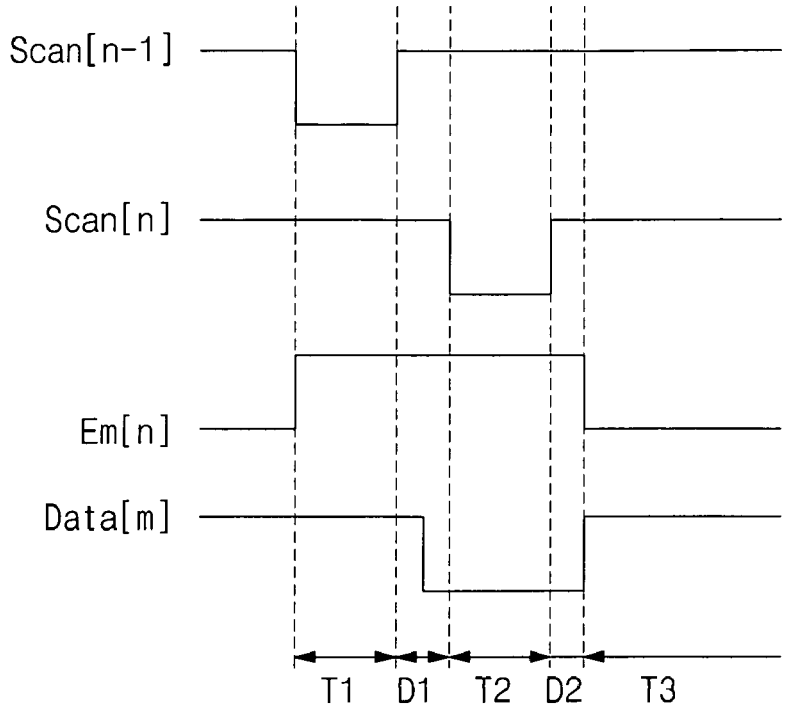
FIG. 3 illustrates a timing diagram of exemplary signals employable to drive the pixel circuit of FIG. 2.

FIG. 3 illustrates a timing diagram of exemplary signals employable to drive the pixel circuit 241 of FIG. 2. Referring to FIG. 3, a driving period for driving the pixel circuit 241 may include an initialization period (T1), a first delay period (D1), a data recording period (T2), a second delay period (D2), and a light emitting period (T3). Hereinafter, an exemplary operation of a pixel circuit of an organic light emitting display according to an exemplary embodiment of the invention will be described with reference to FIGS. 2 to 6.

Figure 4:
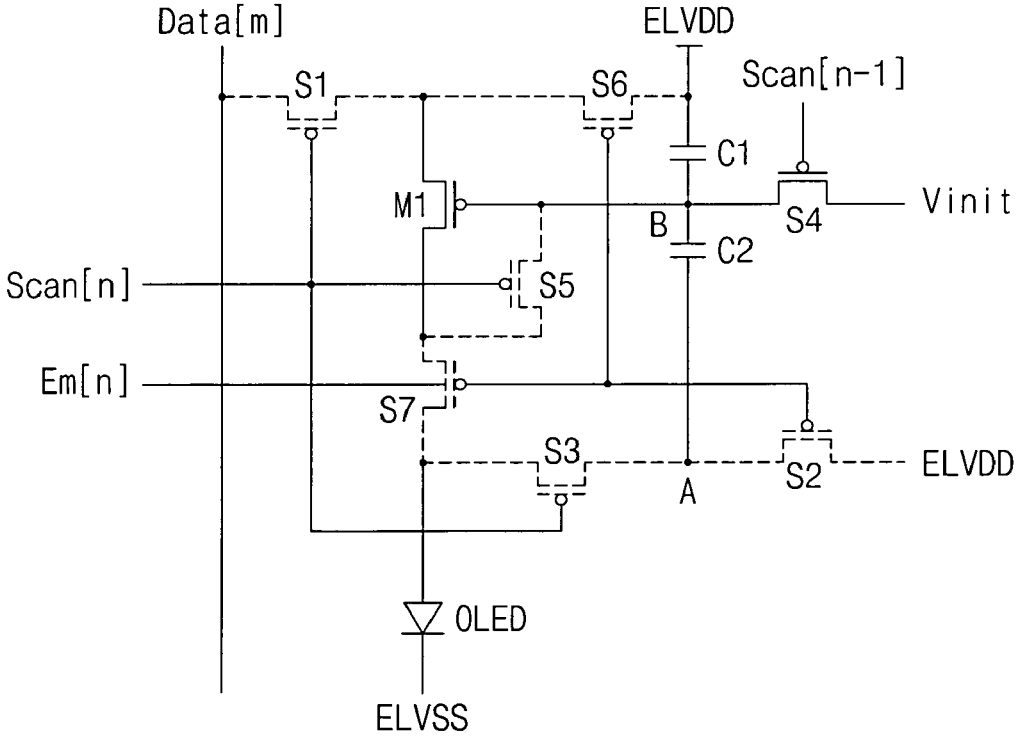
FIG. 4 illustrates an operating state of the pixel circuit of FIG. 2 during an initialization period (T1)

FIG. 4 illustrates an operating state of the pixel circuit 241 of FIG. 2 during the initialization period (T1).

During the initialization period (T1), a previous scan signal of a low level may be applied to the pixel circuit 241 via the previous scan line (Scan[n−1]). During the initialization period (T1), the fourth switching element (S4) may be turned on. Referring to FIG. 2, when fourth switching element (S4) is turned on, the third voltage (Vinit) may be transferred to the control electrode of the driving transistor (M1). At this time, a voltage stored in the first storage capacitor (C1) and a voltage stored in the second storage capacitor (C2), that is, a voltage of the control electrode of the driving transistor (M1), may be initialized.

During the first delay period (D1) between the initialization period (T1) and the data recording period (T2), a data voltage ($V_{DATA}$) supplied to the mth data line (Data[m]) may be changed to a data voltage ($V_{DATA}$) corresponding to the respective one of the pixel circuits, e.g., 241, which is electrically coupled to the nth scan line (Scan[n]), while a scan signal of the scan line (Scan[n]) is maintained at a high level. If there is no first delay period (D1), a previous data voltage, which was applied to the mth data line (Data[m]), may be applied to the driving transistor (M1) through the first switching element (S1) when a scan signal of the nth scan line (Scan[n]) becomes low level before the present data voltage ($V_{DATA}$) is applied. Accordingly, the first delay period (D1) may prevent such a situation.

Figure 5:
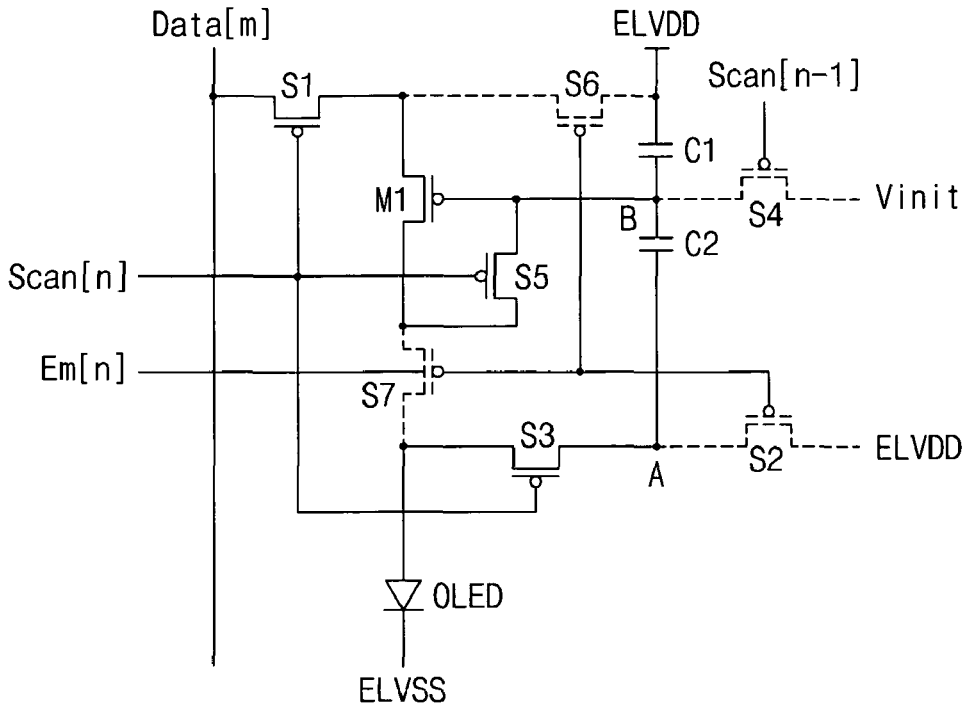
FIG. 5 illustrates an operating state of the pixel circuit of FIG. 2 during a data recording period (T2)

FIG. 5 illustrates an operating state of the pixel circuit of FIG. 2 during the data recording period (T2).

During the data recording period (T2), a scan signal of a low level may be applied, via the scan line (Scan[n]), to the pixel circuit 241. During the data recording period (T2), the first switching element (S1), the third switching element (S3) and the fifth switching element (S5) are turned on.

When the first switching element (S1) is turned on, a data signal supplied to the data line (Data[m]) may be applied to the driving transistor (M1). When the third switching element (S3) is turned on, a threshold voltage ($V_{TH(OLED)}$) of OLED may be applied to the second electrode of the second storage capacitor (C2) via the node (A). When the fifth switching element (S5) is turned on, the driving transistor (M1) may be in a diode-coupled state. When the driving transistor (M1) is in the diode-coupled state, a differential voltage between a data voltage ($V_{DATA}$) applied to the mth data line (Data[m]) and the threshold voltage ($V_{TH}$) of the driving transistor (M1) may be applied to the second and first electrodes of the first and second storage capacitors (C1 and C2), respectively, via the node (B), which may also correspond to the control electrode of the driving transistor (M1). Thus, the threshold voltage of the driving transistor (M1) may be compensated.

During the second delay period (D2) between the data recording period (T2) and the light emitting period (T3), a scan signal of the nth scan line (Scan[n]) may be maintained at a high level for a predetermined period of time before a light emission control signal of the nth light emission control line (Em[n]) becomes a low level. The delay of the second delay period (D2) may correspond to an inherent delay that may occur due to operation of respective elements of the pixel circuit 241. Thus, the second delay period (D2) may prevent an error in controlling the light emission of the OLED.

Figure 6:
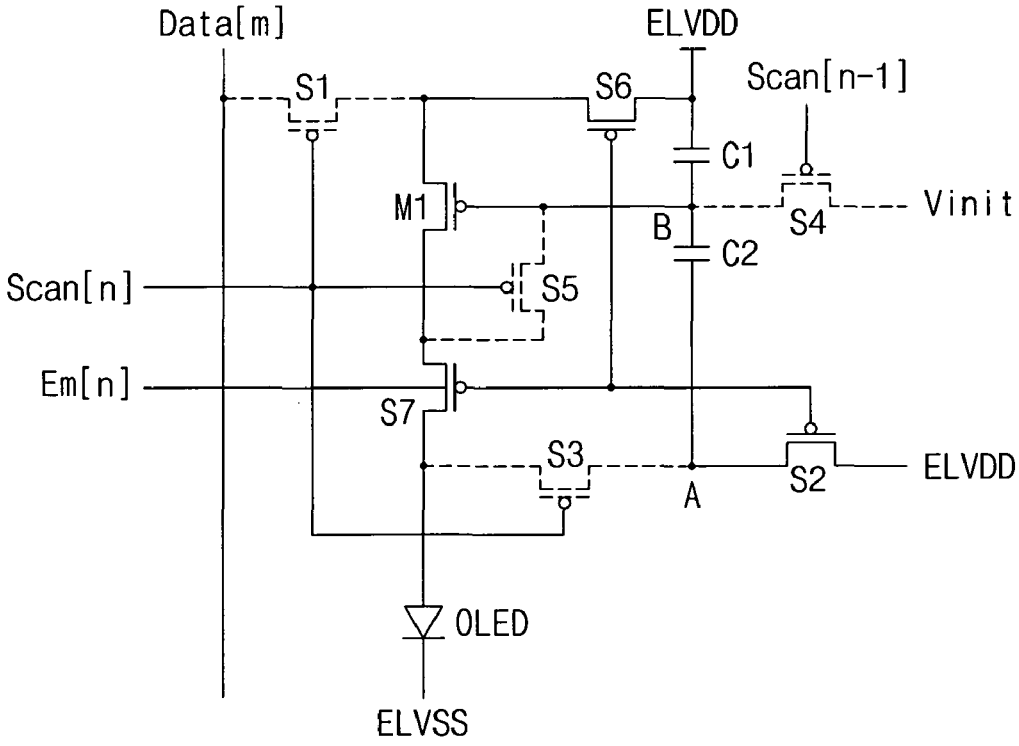
FIG. 6 illustrates an operating state of the pixel circuit of FIG. 2 during a light emitting period (T3)

FIG. 6 illustrates an operating state of the pixel circuit 241 of FIG. 2 during a light emitting period (T3).

During the light emitting period (T3), a light emission control signal of a low level may be applied, via the nth light emission control line (Em[n]), to the pixel circuit 241. During the light emitting period (T3), the second switching element (S2), the sixth switching element (S6), and the seventh switching element (S7) may be turned on.

When the second switching element (S2) is turned on, the first voltage (ELVDD) may be applied to the second electrode (A) of the second storage capacitor (C2). Here, a voltage variance $\Delta V_A$ corresponding to the voltage difference between the data recording period (T2) and the light emitting period (T3) ((T2)→(T3)) of the second electrode of the second storage capacitor (C2), i.e., the node (A) may be as follows:

$$\Delta V_A = ELVDD - V_{THOLED} \quad \text{[Formula 1]}$$

Here, ELVDD is the first voltage, and $V_{TH(OLED)}$ is a threshold voltage of the OLED. That is, the voltage variance $\Delta V_A$ may be represented with a voltage difference between the first voltage ELVDD during the light emitting period (T3) and a voltage $V_{TH(OLED)}$ during the data recording period (T2).

By the voltage variance $\Delta V_A$ of the second electrode (A) of the second storage capacitor (C2), a voltage variance $\Delta V_A$ (T2)→(T3) at the control electrode of the driving transistor (M1), that is, at the second and first electrodes of the first and second storage capacitors (C1 and C2), respectively, i.e., the node (B) is as follows:

$$\begin{aligned}\Delta V_B &= \frac{C_1}{C_1 + C_2}\Delta V_A \\ &= \frac{C_1}{C_1 + C_2}(ELVDD - V_{THOLED})\end{aligned} \quad \text{[Formula 2]}$$

When the sixth switching element (S6), for supplying the first voltage (ELVDD) to the driving transistor (M1), and the seventh switching element (S7) are turned on, a current ($I_{(OLED)}$) corresponding to a gate-source voltage ($V_{GS}$) of the driving transistor (M1) may be applied to the OLED, and the OLED may emit light. The current ($I_{(OLED)}$) is as follows:

$$\begin{aligned}I_{OLED} &= \frac{\beta}{2}(V_{GS} - V_{TH})^2 \\ &= \frac{\beta}{2}(V_{SG} - |V_{TH}|)^2 \\ &= \frac{\beta}{2}(V_S - (V_G + \Delta V_B) - |V_{TH}|)^2 \\ &= \frac{\beta}{2}\Big(ELVDD - (V_{DATA} - |V_{TH}|) - \\ &\quad \frac{C_1}{C_1 + C_2}(ELVDD - V_{THOLED}) - |V_{TH}|\Big)^2 \\ &= \frac{\beta}{2}\Big(ELVDD - V_{DATA} - \\ &\quad \frac{C_1}{C_1 + C_2}(ELVDD - V_{THOLED})\Big)^2\end{aligned} \quad \text{[Formula 3]}$$

Here, ELVDD is the first voltage, $V_G$ is a control electrode (gate) voltage of the driving transistor (M1), $V_S$ is a source voltage of the driving transistor (M1), $V_{TH(OLED)}$ is a threshold voltage of the OLED, $V_{DATA}$ is a data voltage, and $V_{TH}$ is a threshold voltage of the driving transistor (M1).

As can be seen from Formula 3, in some embodiments of the invention, if a threshold voltage ($V_{TH(OLED)}$) increases due to, e.g., deterioration of the OLED, a driving current ($I_{(OLED)}$) supplied to the OLED may increase. Hence, in embodiments of the invention, if the efficiency of the OLED is reduced, a driving current ($I_{(OLED)}$) applied to the OLED may be increased to substantially and/or completely compensate for the reduction in efficiency of the OLED. Accordingly, some embodiments of the invention may enable image sticking due to a decrease in efficiency of the OLED to be reduced and/or prevented.

As can be seen from Formula 3, a driving current ($I_{(OLED)}$) applied to the OLED may be completely and/or substantially indifferent to a threshold voltage of the driving transistor (M1). That is, in embodiments, a threshold voltage of the driving transistor (M1) may be offset by a gate voltage ($V_{DATA}$−$|V_{TH}|$) of the driving transistor (M1) stored during the data recording period (T2). Hence, in some embodiments of the invention, the OLED of each pixel circuit 141 (see FIG.

1) emits light of the same brightness irrespective of a difference between threshold voltage ($V_{TH}$) values of the respective driving transistors (M1), and thus it is possible to realize a high-grayscale organic light emitting display.

Figure 7:
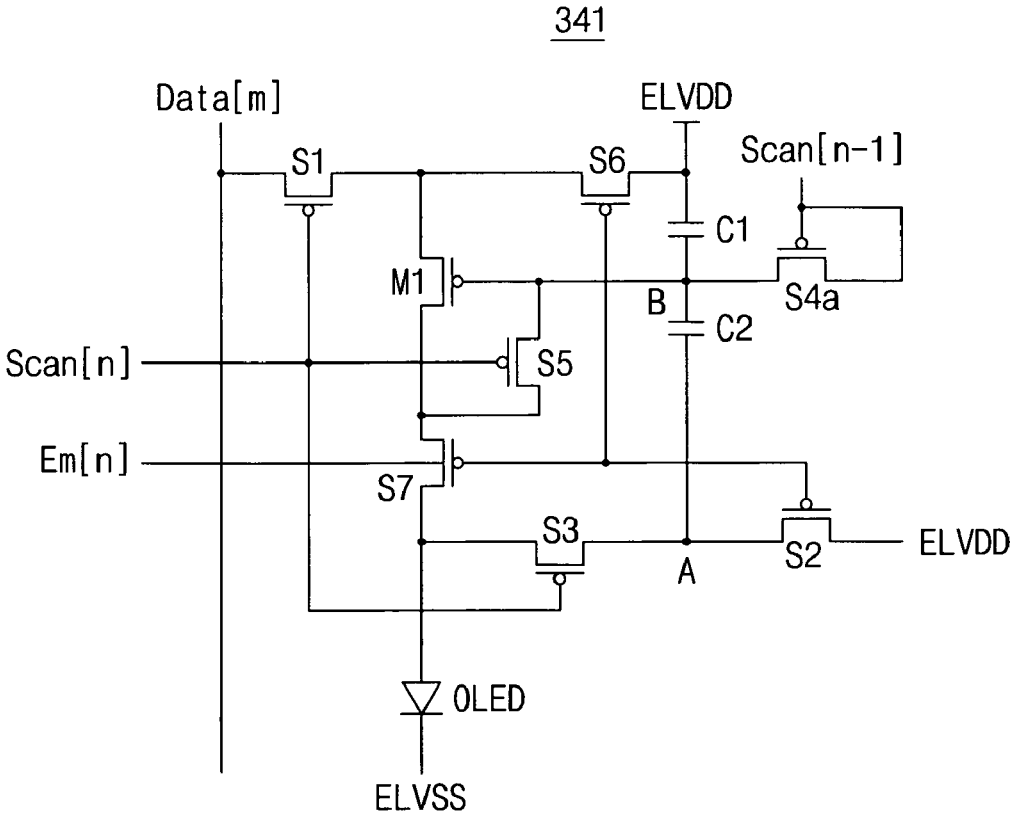
FIG. 7 illustrates a circuit diagram of another exemplary pixel circuit employable by an organic light emitting display according to another embodiment of the invention.

FIG. 7 illustrates a circuit diagram of another exemplary pixel circuit 341 employable by an organic light emitting display according to another embodiment of the invention. For example, one, some, or all of the pixel circuits 141 of the organic light emitting display of FIG. 1 may correspond to the pixel circuit 341 illustrated in FIG. 7. For ease of description, the pixel circuit 341 is illustrated as being coupled to the nth scan line (Scan[n]), the mth data line (Data[m]) and the nth light emission control line (Em[n]) of the organic light emitting display 100 of FIG. 1.

As described in FIG. 7, the pixel circuit 341 may have the same structure as the exemplary pixel circuit 241 of FIG. 2. In general, only differences between the pixel circuit 341 of FIG. 7 and the pixel circuit 241 of FIG. 2 will be described below. In the pixel circuit 341, a fourth switching element (S4*a*) may include a first electrode electrically coupled to the control electrode of the driving transistor (M1), and a second electrode and a control electrode electrically coupled to the previous scan line (Scan[n−1]) such that the fourth switching element (S4*a*) may be in a diode-coupled state. When the fourth switching element (S4*a*) is turned on to transfer a previous scan signal to the control electrode of the driving transistor (M1), a voltage stored in the first storage capacitor (C1) and the second storage capacitor (C2) may be initialized.

Figure 8:
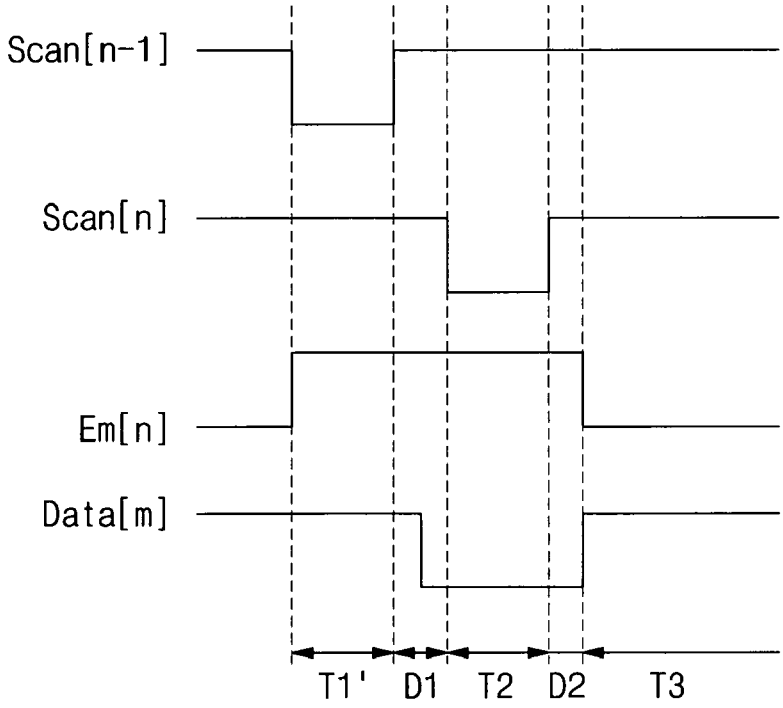
FIG. 8 illustrates a timing diagram of exemplary signals employable for driving the pixel circuit of FIG. 7.

FIG. 8 illustrates a timing diagram of exemplary signals employable for driving the pixel circuit 341 of FIG. 7.

In general, operation of the pixel circuit 341 of FIG. 7 is the same as that of the pixel circuit 241 of FIG. 2, except for an initialization period (T1'). More specifically, during an initialization period (T1'), a scan signal of a low level may be applied from the previous scan line (Scan[n−1]), and thus the fourth switching element (S4*a*) may be turned on. When the fourth switching element (S4*a*) is turned on, a scan signal of the previous scan line (Scan[n−1]) may be transferred to the control electrode of the driving transistor (M1). More particularly, when the fourth switching element (S4*a*) is turned on, a voltage stored in the first storage capacitor (C1) and a voltage stored in the second storage capacitor (C2), that is, a voltage of the control electrode of the driving transistor (M1), may be initialized.

As described above, an organic light emitting display employing one or more aspects of the invention may be advantageous by reducing and/or preventing image sticking due to a decrease in efficiency of an organic light emitting diode by controlling an amount of a current supplied to the organic light emitting diode.

Embodiments of the invention may provide an organic light emitting display that may be advantageous by realizing high-grayscale by compensating for irregularity of a threshold voltage of a driving transistor of a pixel circuit.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An organic light emitting display, comprising:

a first switching element including a control electrode directly coupled to a scan line and being electrically coupled between a data line and a first voltage line;

a driving transistor electrically coupled between the first voltage line and a second voltage line, wherein the driving transistor is electrically coupled to a fourth switching element adapted to initialize a voltage stored in a first storage capacitor and a second storage capacitor, the second storage capacitor being different from the first storage capacitor, by applying an initialization voltage to a control electrode of the driving transistor;

a second switching element including a control electrode electrically coupled to a light emission control line and being electrically coupled between the first voltage line and the driving transistor;

a third switching element including a control electrode directly coupled to the scan line and being electrically coupled between the second switching element and the driving transistor;

the first storage capacitor being directly electrically coupled between the first voltage line and the control electrode of the driving transistor;

the second storage capacitor being electrically coupled between the first storage capacitor and the second switching element, the first storage capacitor including a first electrode directly electrically coupled to the first voltage line and a second electrode directly electrically coupled between a control electrode of the driving transistor and a first electrode of the second storage capacitor; and an organic light emitting diode electrically coupled between the driving transistor and the second voltage line.

2. The organic light emitting display as claimed in claim 1, wherein the first switching element includes a first electrode electrically coupled to the data line, and a second electrode electrically coupled to a first electrode of the driving transistor.

3. The organic light emitting display as claimed in claim 1, wherein the second switching element includes a first electrode electrically coupled between the third switching element and the second storage capacitor, and a second electrode electrically coupled to the first voltage line.

4. The organic light emitting display as claimed in claim 1, wherein the third switching element includes a first electrode electrically coupled to an anode of the organic light emitting diode, and a second electrode electrically coupled to a first electrode of the second switching element.

5. The organic light emitting display as claimed in claim 1, wherein the second storage capacitor includes a first electrode electrically coupled to a control electrode of the driving transistor and a second electrode electrically coupled between a first electrode of the second switching element and a second electrode of the third switching element.

6. The organic light emitting display as claimed in claim 1, wherein the driving transistor includes a control electrode directly electrically coupled between the first storage capacitor and the second storage capacitor, a first electrode electrically coupled between the first switching element and the first voltage line, and a second electrode electrically coupled to an anode of the organic light emitting diode.

7. The organic light emitting display as claimed in claim 1, wherein the organic light emitting diode includes an anode electrically coupled between a first electrode of the third switching element and a second electrode of the driving transistor and a cathode electrically coupled to the second voltage line.

8. The organic light emitting display as claimed in claim 1, wherein the fourth switching element includes a control electrode electrically coupled to a previous scan line, a first electrode electrically coupled between the first storage capacitor and the second storage capacitor, and a second electrode electrically coupled to a third voltage line.

9. The organic light emitting display as claimed in claim 1, wherein the driving transistor is electrically coupled to a fifth switching element that connects the driving transistor in a diode-coupled manner.

10. The organic light emitting display as claimed in claim 9, wherein the fifth switching element includes a control electrode electrically coupled to the scan line, a first electrode electrically coupled to a control electrode of the driving transistor, and a second electrode electrically coupled between an anode of the organic light emitting diode and a second electrode of the driving transistor.

11. The organic light emitting display as claimed in claim 1, wherein the driving transistor is electrically coupled to a sixth switching element that applies a first voltage to the driving transistor.

12. The organic light emitting display as claimed in claim 11, wherein the sixth switching element includes a control electrode electrically coupled to the light emission control line, a first electrode electrically coupled between the first switching element and the driving transistor, and a second electrode electrically coupled between the first voltage line and the first storage capacitor.

13. The organic light emitting display as claimed in claim 1, further comprising a seventh switching element that is adapted to apply a driving current to the organic light emitting diode and is electrically coupled between the driving transistor and the organic light emitting diode.

14. The organic light emitting display as claimed in claim 13, wherein the seventh switching element includes a control electrode electrically coupled to the light emission control line, a first electrode electrically coupled between the driving transistor and a fifth switching element, and a second electrode electrically coupled between the organic light emitting diode and the third switching element.

15. The organic light emitting display as claimed in claim 1, further comprising:

a fourth switching element that is electrically coupled between the first storage capacitor and a third voltage line and includes a control electrode electrically coupled to a previous scan line;

a fifth switching element adapted to connect the driving transistor is a diode-coupled manner;

a sixth switching element including a control electrode electrically coupled to the light emission control line and being electrically coupled between the driving transistor and the first voltage line; and a seventh switching element including a control electrode electrically coupled to the light emission control line and being electrically coupled between the driving transistor and the organic light emitting diode.

16. The organic light emitting display as claimed in claim 15, wherein the fourth switching element includes a first electrode electrically coupled between the first storage capacitor and the second storage capacitor, and a second electrode electrically coupled to the third voltage line.

17. The organic light emitting display as claimed in claim 15, wherein the sixth switching element includes a first electrode electrically coupled between the first switching element and the driving transistor, and a second electrode electrically coupled between the first voltage line and the first storage capacitor.

18. The organic light emitting display as claimed in claim 15, wherein the seventh switching element includes a first electrode electrically coupled to the driving transistor, and a second electrode electrically coupled between the organic light emitting diode and the third switching element.

19. The organic light emitting display as claimed in claim 1, wherein a second voltage of the second voltage line is lower than a first voltage of the first voltage line.

20. The organic light emitting display as claimed in claim 1, further comprising:

wherein the fourth switching element electrically coupled between the first storage capacitor and a previous scan line and includes a control electrode electrically coupled to the previous scan line;

a fifth switching element that is adapted to diode-couple the driving transistor;

a sixth switching element including a control electrode electrically coupled to the light emission control line and being electrically coupled between the driving transistor and the first voltage line; and a seventh switching element including a control electrode electrically coupled to the light emission control line and being electrically coupled between the driving transistor and the organic light emitting diode.

21. The organic light emitting display as claimed in claim 20, wherein the fourth switching element includes a first electrode electrically coupled between the first storage capacitor and the second storage capacitor, and a second electrode electrically coupled to the previous scan line.

22. The organic light emitting display as claimed in claim 20, wherein the sixth switching element includes a first electrode electrically coupled between the first switching element and the driving transistor, and a second electrode electrically coupled between the first voltage line and the first storage capacitor.

23. The organic light emitting display as claimed in claim 20, wherein the seventh switching element includes a first electrode electrically coupled to the driving transistor, and a second electrode electrically coupled between the organic light emitting diode and the third switching element.

24. An organic light emitting display, comprising:

a first switching element including a control electrode directly coupled to a scan line and being electrically coupled between a data line and a first voltage line;

a driving transistor electrically coupled between the first voltage line and a second voltage line, wherein the driving transistor is electrically coupled to a fourth switching element adapted to initialize a voltage stored in a first storage capacitor and a second storage capacitor, the second storage capacitor being different from the first storage capacitor, by applying an initialization voltage to a control electrode of the driving transistor;

a second switching element including a control electrode electrically coupled to a light emission control line and being electrically coupled between the first voltage line and the driving transistor;

a third switching element including a control electrode directly coupled to the scan line and being electrically coupled between the second switching element and the driving transistor;

the first storage capacitor being directly electrically coupled between the first voltage line and the control electrode of the driving transistor;

the second storage capacitor being electrically coupled between the first storage capacitor and the second switching element; and an organic light emitting diode electrically coupled between the driving transistor and the second voltage line, the driving transistor including a control electrode directly electrically coupled between the first storage capacitor and the second storage capacitor, a first electrode electrically coupled between the first switching element and the first voltage line, and a second electrode electrically coupled to an anode of the organic light emitting diode.

* * * * *